United States Patent [19]

Naito et al.

[11] 3,978,433

[45] Aug. 31, 1976

[54] MAGNETIC TRANSMISSION DEVICES USING THE EDGE-GUIDED MODE OF PROPAGATION

[75] Inventors: Yoshiyuki Naito; Kiyomichi Araki, both of Tokyo; Tetsu Koyama, Yokosuka, all of Japan

[73] Assignee: Yoshiyuki Naito, Tokyo, Japan

[22] Filed: May 6, 1975

[21] Appl. No.: 574,939

[30] Foreign Application Priority Data

May 15, 1974 Japan ..... 49-58056
Nov. 20, 1974 Japan ..... 49-132690

[52] U.S. Cl. ..... 333/1.1; 333/24.2
[51] Int. Cl.[2] ..... H01P 1/36; H01P 1/38
[58] Field of Search ..... 333/1.1, 24.1, 24.2

[56] References Cited

UNITED STATES PATENTS

| | | | |
|---|---|---|---|
| 3,538,459 | 11/1970 | Knerr | 333/1.1 |
| 3,617,951 | 11/1971 | Anderson | 333/1.1 |
| 3,835,420 | 9/1974 | Orime et al. | 333/24.2 |

*Primary Examiner*—Paul L. Gensler
*Attorney, Agent, or Firm*—Wenderoth, Lind & Ponack

[57] ABSTRACT

A magnetic transmission device using the edge-guided mode of propagation includes a magnetic dielectric slab having a conductor plate member mounted thereon adapted to be magnetized perpendicular to a ground plane on which the slab is placed. The conductor plate member is partially short-circuited to the ground plane.

10 Claims, 16 Drawing Figures

MAGNETIC TRANSMISSION DEVICES USING THE EDGE-GUIDED MODE OF PROPAGATION

BACKGROUND OF THE INVENTION

This invention relates to magnetic transmission devices using the edge-guided mode of propagation, and, more particularly, to microstrip and stripline transmission devices such as isolators, multi-port circulators, reflection-type amplifiers, and phase shifters.

In microstrip and stripline transmission devices using ferrite dielectric slabs magnetized perpendicular to the ground plane, it is known that the fields are concentrated along one edge and decayed along the opposite edge, so that microwaves are said to be guided or propagated along the edge. Using the principles of such edge-guided mode, it has been proposed to provide ferrite transmission devices of nonreciprocal modes, such as isolators and phase shifters, by asymmetrically loading the edges with a Mylar film coated with thin-film metallization (M. E. Hines: "Reciprocal and Nonreciprocal Modes of Propagation in Ferrite Stripline and Microstrip Devices", IEEE Transactions on Microwave Theory and Techniques, vol. MTT-19, No. 5, May 1971). For a better understanding of the ferrite transmission device using the principles of edge-guided mode and the device proposed by M. E. Hines, we now refer to FIG. 1*a* through FIG. 1*d*, in which:

FIG. 1*a* is a schematic perspective view showing a microstripline transmission device, FIGS. 1*b* and 1*c* are graphs showing the distribution of microwaves in the transverse direction of a conductor, wherein FIGS. 1*b* and 1*c* show distribution of the waves travelling in the forward direction A and reverse direction B, respectively, and FIG. 1*d* is a schematic perspective view showing an isolator proposed by M. E. Hines.

Referring to a microstripline transmission device shown in FIG. 1*a* in which a conductor plate member 1 is mounted on a ferrite slab 2 placed on a ground plane 3, when a DC magnetic field is applied perpendicular to the ground plane 3 as shown by an arrow Hdc, microwaves travelling in the forward direction of an arrow A are concentrated along the left side edge of the conductor plate member 1 and decay along the right side edge thereof as shown in FIG. 1*b*, while microwaves travelling in the reverse direction shown by an arrow B are concentrated along the right side edge of the conductor plate member 1 and decay along the left side edge thereof as shown in FIG. 1*c*.

On the basis of the principles of a edge-guided mode of propagation, it has been proposed that when a lossy material, such as capacitance loading material or a resistive sheet (e.g. mylar) coated with carbon powder, 4 is provided along one edge of the conductor, for example along the right side edge as shown in FIG. 1*d*, microwaves travelling in the forward direction shown by an arrow A propagate along the left side edge, while microwaves travelling in the reverse direction shown by an arrow B are mostly absorbed in the lossy material 4. Accordingly, it is said that such ferrite transmission device can be used as an isolator.

However, in such an isolator, although microwaves inserted in the forward direction are propagated along one edge opposite to the lossy material, it has been noted that a relatively large amount of microwaves in the reverse direction are also propagated without being absorbed in the lossy material, so that the forward-reverse ratio is relatively low. For example, in microwaves having frequencies of 5.0 – 7.5 GHz, the insertion loss is about −1dB, isolation is about −20dB, and thereby the forward-reverse ratio is 20 at most.

SUMMARY OF THE INVENTION

Accordingly, an object of the present invention is to provide new improved magnetic transmission devices using the edge-guided mode of propagation.

Another object of the present invention is to provide magnetic transmission devices of the type defined above, wherein isolation is improved compared with that of known devices.

Another object of the present invention is to provide magnetic transmission devices of the type defined above, wherein the forward-reverse ratio of microwave transmission is greatly improved compared with known devices.

A further object of the present invention is to provide a new magnetic transmission device which effectively separates the signal input line from the signal output line.

A still further object of the present invention is to provide magnetic transmission devices of the type defined above, which are simple in structure and inexpensive in manufacturing costs.

The applicants of the present invention have made extensive experiments to improve the isolation and the forward-reverse ratio of microwave transmission in an isolator and have discovered the new fact that when an intermediate edge portion of an upper conductor plate mounted on a ferrite slab is short-circuited to the ground plane, microwaves travelling along this edge portion are substantially not propagated, nor reflected by the short-circuiting portion. From theoretical analyses and experiments, it was found that microwaves travelling along the short-circuited edge portion are consumed or absorbed by the loss of ferrite itself (i.e. that the reverse waves are consumed or absorbed within the ferrite slab) and that the phenomenon caused by the short-circuiting of the conductor plate is quite different from that of the known isolator in which a lossy material is provided on an edge of the conductor plate to absorb waves. On the basis of such new fact or phenomenon, the applicants of the present invention have developed magnetic transmission devices using the edge-guided mode of propagation and have achieved the present invention.

That is, according to the present invention, a magnetic transmission device using the edge-guided mode of propagation comprises a magnetic dielectric slab having a conductor plate member mounted thereon and adapted to be magnetized in a direction perpendicular to a ground plane on which the slab is placed, wherein the conductor plate member is partially short-circuited to the ground plane.

In an isolator using the edge-guided mode of propagation according to one embodiment of the present invention, the conductor plate member is partially short-circuited to the ground plane at an intermediate edge portion along which microwaves in the reverse direction are concentrated for propagation. The intermediate edge portion to be short-circuited may partially extend along the edge in the direction of propagation or may partially extend a direction transverse to the direction of propagation.

In a circulator having three or more parts according to another embodiment of the present invention, the conductor plate member is partially short-circuited to the ground plane at an internal portion along which decayed microwaves travel. Preferably, the short-circuited portion has sides each opposed to an edge between two adjacent ports. For example, when the circulator has three ports, the short-circuited portion is substantially triangular shaped in plan view with its three sides opposed to three edge lines of the circulator along which waves are propagated.

According to another embodiment of the present invention, the magnetic transmission device has three or more ports, and an intermediate edge portion of the conductor member between one of the two adjacent ports is partially short-circuited to the ground plane. Such magnetic transmission device has an advantage when used for a reflection-type amplifier, digital a phase modulator, and a switching element.

BRIEF DESCRIPTION OF THE DRAWINGS

The aforementioned and other objects and features of the present invention will be apparent from the following detailed description of specific embodiments thereof, when read in conjunction with the accompanying drawings, in which:

FIGS. 1*b* and 1*c* are graphs showing the distribution of microwaves in the transverse direction of a conductor, wherein FIGS. 1*b* and 1*c* show distribution of the waves travelling in the forward direction A and reverse direction B, respectively.

DETAILED DESCRIPTION OF THE INVENTION

Figure 1A:
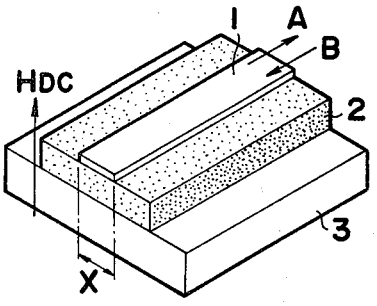
FIG. 1a Prior Art
FIG. 1*a* is a schematic perspective view showing a microstripline transmission device.
Figure 1B:
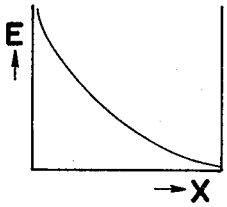
Figure 1C:
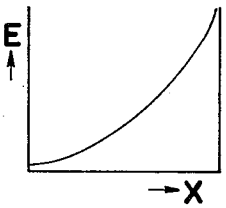
Figure 1D:
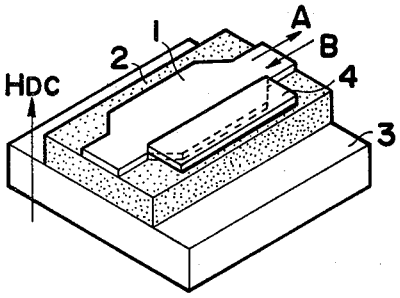
FIG. 1d Prior Art
FIG. 1*d* is a schematic perspective view showing an isolator proposed by M. E. Hines.
Figure 2:
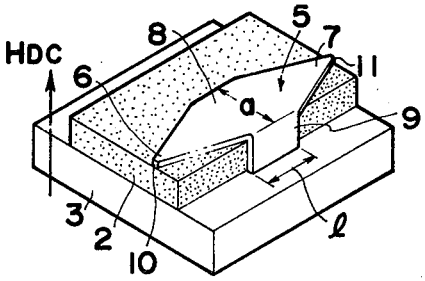
FIG. 2 is a perspective view showing an isolator according to one embodiment of the present invention.

Referring to an isolator according to an embodiment of the present invention shown in FIG. 2, a ferrite dielectric slab 2 is placed on a ground plane 3 in the same manner as described in the known isolator shown in FIGS. 1a and 1d. A conductor plate 5 is mounted on the ferrite slab 2 and has two tapered line end sections or portions 6 and 7 between input and output ports 10, 11 and intermediate wide stripline section 8 between sections 6 and 7 in order to suppress the reflection due to the change in characteristic impedance of the resultant transmission line. The conductor plate 5 is connected or electrically short-circuited to the ground plane 3 by a sleeve or projection 9 integrally extending from one of the edges of the intermediate portion 8 of the conductor plate 5 along the side surface of the ferrite slab 2. The sleeve 9 need not be integral with the conductor plate 5 but may be a conductive plate member connected to one edge of the intermediate portion 8 of the conductor plate 5 and the ground plane.

When the present isolator shown in FIG. 2 is placed in a DC magnetic field which is perpendicular to the ground plane 3 as shown by an arrow $H_{DC}$, one might consider that microwaves inserted from the port 11 and travelling in the reverse direction toward the port 10 will be mostly reflected due to the short-circuited edge, but this does not occur.

Figure 3:
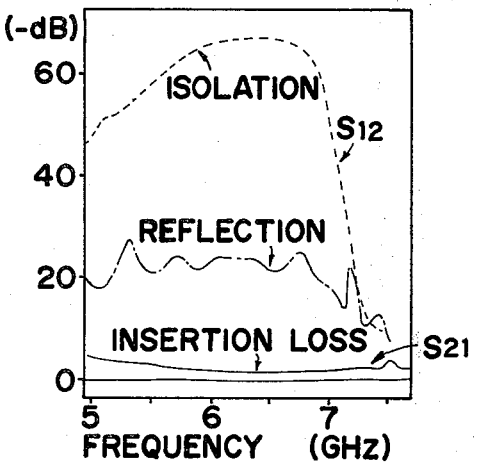
FIGS. 3 to 5 are graphs showing isolation and forward loss characteristics of the present isolator of the type shown in FIG. 2.

One of the experimental results is shown in FIG. 3, in which a ferrite slab (YIG) having magnetic saturation of 4 $\pi$Ms = 1750 (Gauss) at 10 GHz and magnetic resonance half power width of $\Delta H = 84$ (Oe) at 10 GHz was formed 1 mm thick. A conductor plate 5 having a width $a = 10$ mm at the intermediate portion 8 and a short-circuiting sleeve having a length $l = 20$ mm was made of aluminum foil. The internal magnetic field of the ferrite $Hi = H_{DC} - 4\pi \cdot Ms$ was 800 (Oe). As is apparent from FIG. 3, the reflections are less than about −15dB. One might consider that the reverse loss could be due to radiation. However, from subsequent theoretical and experimental investigations, it was found that most of the reverse waves are consumed or absorbed within the ferrite slab itself.

Comparing the experimental results of the present isolator with those of the known isolator in which the lossy material 4 such as a resistance film overlay is used for absorbing waves, the isolation and forward-reverse loss ratio of the present isolator are remarkably improved in a frequency band of 5.0 – 7.5 GHz. That is, the present isolator, the insertion loss is about −1dB, isolation can be more than −45dB, and the forward-reverse loss ratio can be more than 45, while, in the known isolator, the insertion loss is about −1dB, isolation is about −20dB, and the forward-reverse loss ratio is about 20 at most.

Then, the present isolator of the same type as mentioned in connection to FIGS. 2 and 3 is subjected to further experiments by varying the length (l) of the short-circuiting sleeve 9, in which 4 $\pi$Ms = 1750 (Gauss); $\Delta H = 83$ (Oe); external DC magnetic field HO = 2550 Oe. The experimental results were plotted in graphs shown in FIG. 4.

Figure 4:
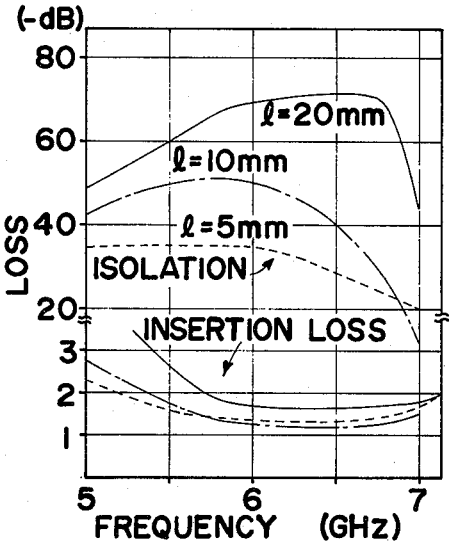

As is apparent from FIG. 4, isolation is increased as the length (l) of the sleeve becomes longer. However, the increase of isolation is not in proportion to the increase in the length of the sleeve 9. In other words, when the sleeve 9, i.e. the short-circuiting portion thereof, has a short length of about 5 mm, a high isolation of about 30dB is obtained. Further, when the length (l) becomes longer, further insertion loss only slightly increases.

Figure 5:
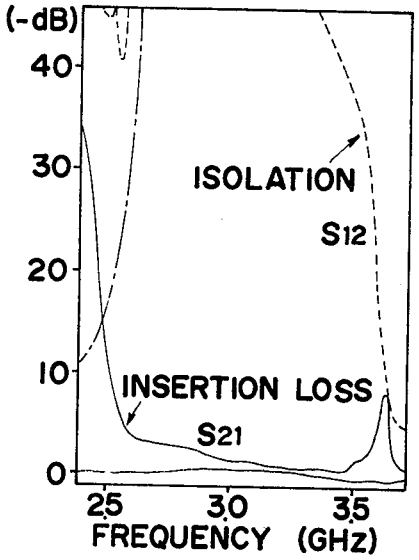

FIG. 5 also shows other experimental results of the present isolator in which a ferrite slab having 4 $\pi$Ms = 580 (Gauss), $\Delta H = 49$ (Oe) and Hi = 1300 (Oe) was subjected to experiments with the conductor plate of $a = 16$ mm and a short circuiting sleeve of $l = 38$ mm. As is apparent from FIG. 5, the effective frequency band applicable to the present isolator can be varied by selecting a ferrite slab having different magnetic properties.

In the experimental results of the present isolator, the effective frequency band was relatively narrow. However, it will be possible to widen the band by varying the magnetic field intensity distribution applied to the ferrite slab. Further, the insertion loss may be reduced by using a ferrite slab which has a smaller $\Delta H$.

Thus, the isolator according to the present invention shows a remarkable advantage without using the lossy material of the known isolator.

Figure 6:
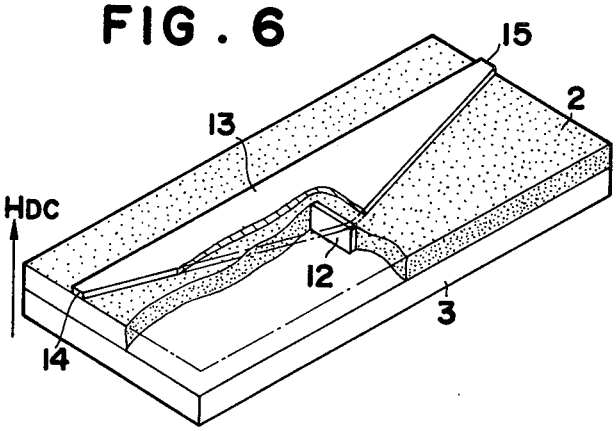
FIG. 6 is a perspective view showing an isolator according to another embodiment of the present invention.

Another isolator according to a second embodiment of the present invention is shown in FIG. 6, in which a short-circuiting conductive plate member 12 partially extends in a direction transverse to a conductor plate 13 from an edge thereof. The conductor plate 13 in this embodiment is substantially triangular with opposite acute angled end portions forming ports 14 and 15. The short-circuiting conductive plate member 12 extends partially from the other obtuse angled edge portion in a direction transverse to the direction of wave transmission.

Figure 7:
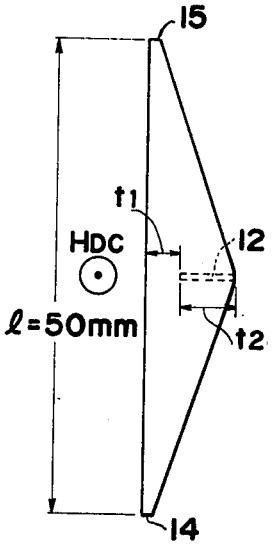
FIG. 7 is a schematic plan view showing a conductor plate member in the isolator shown in FIG. 6.

In such an isolator as shown in FIGS. 6 and 7, microwaves forwardly inserted from the port 14 are concentrated along the left side edge in FIG. 7 due to the characteristics of the edge-guided mode and are propagated to the other port 15 without substantial insertion loss. On the other hand, microwaves reversely inserted from the port 15 are interrupted from propagating and are greatly decayed due to the loss of the ferrite of that portion, and the waves reflected by the short-circuiting conductive plate are very few.

Figure 8:
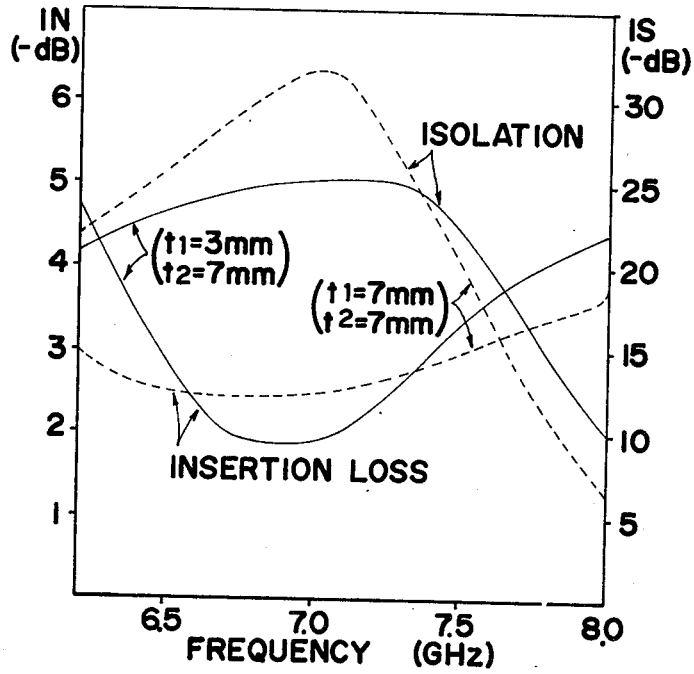
FIG. 8 is a graph showing isolation and insertion characteristics of the present isolator of the type shown in FIG. 6, FIGS. 9 and 10 are perspective views each showing a circulator according to different embodiments of the present invention.

Such facts were confirmed in the following experiments, to which the ferrite slab had magnetic saturation $4\pi Ms = 1750$ Gauss and magnetic resonance half power width $\Delta H = 83$ Oe, and the length (l) of the upper conductor plate was 50mm. In the experiments, the length $t_2$ of the short-circuiting conductive plate 12 and the width $t_1$ between the inner edge of the short-circuiting plate 12 and the left edge of the conductor plate 13 were varied. FIG. 8 shows the experimental results obtained.

As it will be noted from FIG. 8, the isolation and insertion loss characteristics of the isolator according to the second embodiment are somewhat inferior to those of the isolator according to the first embodiment. However, the isolator of the second embodiment will function well in practical use and the frequency band applicable thereto may also be widened by varying the magnetic field intensity distribution.

As will be apparent from the description set forth above, the isolators according to the present invention are based upon new phenomenon or principles which are different from those using lossy material such as resistance material.

By developing the principles of the present invention, other ferrite transmission devices are provided.

Figure 9:
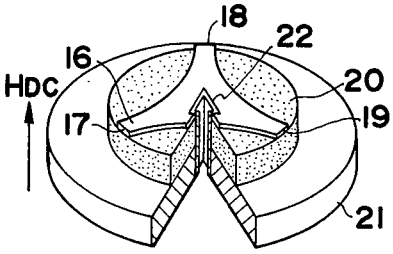

In FIG. 9 there is shown a three-port circulator using the edge-guided mode of propagation. In this embodiment, a substantially triangular shaped conductor plate 16 having three ports 17, 18 and 19 is mounted on a disc-shaped ferrite slab 20 which, in turn, is placed on a disc-shaped ground plane 21. At the center portion of the conductor plate 16 between the three ports 17 – 19, there is provided a conductive member 22 connecting the conductor plate 16 to the ground plane 21 through the ferrite slab 20, for short-circuiting therebetween. The conductive member 22 is triangular shaped in plan view, and the three sides thereof are opposed to three edge lines between the port 17 – 19.

When a DC magnetic field is applied perpendicular to the ground plane as shown by the arrow in FIG. 9, microwaves inserted from the port 17 are concentrated along the left side edge of the conductor plate 16 between the ports 17 and 18 and propaged to the port 18. Likewise, microwaves from the ports 18 and 19 are propagated to the ports 19 and 17, respectively. Reversing the magnetic field reverses the circulation direction, i.e. from port 17 to 19, 19 to 18, and 18 to 17.

Figure 10:
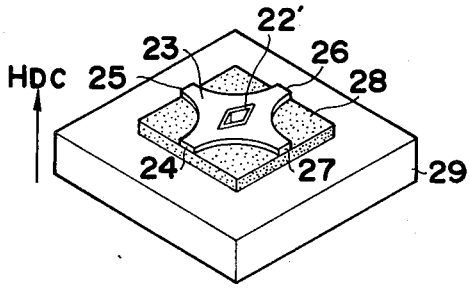

In another embodiment shown in FIG. 10, a four-port circulator using the edge-guided mode of propagation is shown. In this embodiment, a star-shaped conductor plate 23 having four ports 24 – 27 is mounted on a square-shaped ferrite slab 28 which, in turn, is placed on a square-shaped ground plane 29. At the center portion of the conductor plate 23, there is provided a conductive member 22' connecting the upper conductor plate 23 to the ground plane 29 through the ferrite slab 28 for short-circuiting therebetween. The conductive member 22' is diamond shaped in plan view and the four sides thereof are opposed to four edge lines between the ports 24 – 27 of the star-shaped conductor plate 23.

When a DC magnetic field is applied perpendicularly to the ground plane 29 as shown by the arrow in FIG. 10, microwaves inserted from the port 24 are concentrated along the edge of the conductor plate 23 between the ports 24 and 25 and propagated to the port 25. Likewise, microwaves from the ports 25, 26 and 27 are propagated to the ports 26, 27 and 24, respectively. Reversing the magnetic field reverses the circulation direction, i.e. from port 24 to 27, 27 to 26, 26 to 25 and 25 to 24.

In both embodiments of the circulator shown in FIGS. 9 and 10, microwaves inserted in one port are effectively propagated to the selected port with a lower insertion loss compared with the known circulator.

Figure 11:
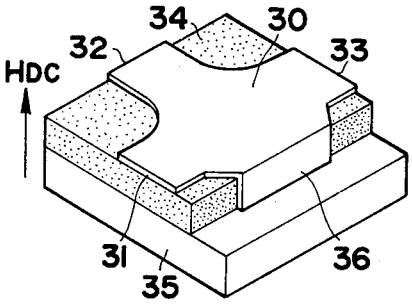
FIGS. 11 to 13 are perspective views each showing another type of ferrite transmission device according to different embodiments of the present invention.

FIG. 11 shows another type of ferrite transmission device to be used in circuits such as a reflection-type amplifier, and a digital phase modulator, in which it is desired that the signal input line be effectively separated from the signal output line. In the embodiment shown in FIG. 11, a substantially T-shaped conductor plate member 30 having three ports 31 – 33 is mounted on a rectangular shaped ferrite slab 34 which, in turn, is placed on a rectangular shaped ground plane 35. An intermediate edge portion between the opposing ports 31 and 33 is integrally provided with a conductive sleeve or projection 36 connecting the upper conductor plate 30 to the ground plane 35 for short-circuiting therebetween. Although the conductive sleeve 36 is provided at the intermediate edge portion between the opposing ports 31 and 33, it may be provided at any one of the intermediate edge portions between the adjacent two ports 31 and 32 or 32 and 33.

In such an arrangement of the ferrite transmission device shown in FIG. 11, when a DC magnetic field is applied perpendicular to the ground plane 35 as shown by the arrow in FIG. 11, microwaves from the ports 31 and 32 are propagated to the adjacent ports 32 and 33, respectively, by the edge-guided mode of propagation, but microwaves from the port 33 cannot be propagated to the port 31 due to the short-circuiting conductive sleeve 36.

When the ferrite transmission device of this embodiment is used as a reflection-type amplifier by connecting a negative resistance element (not shown) as an amplifier to the port 32 and a load (not shown) to the port 33, microwaves inserted into the first port 31 are propagated along the edge between the ports 31 and 32 to the second port 32, where the microwaves are amplified by the negative resistance element. The amplified microwaves are then propagated along the edge between the ports 32 and 33 to the third port 33, where most of the microwaves are taken out as an output signal through the load. A part of the amplified microwaves not matched with the load in the third port 33 is reflected and travels toward the first port 31. In this case, if the amplified reflected microwaves are propagated as a feedback signal to the first port 31, such amplified waves cannot be neglected in view of the inserted wave and the reflection-type amplifier cannot attain its object. However, according to the embodiment of the present invention, such reflected microwaves are consumed by the ferrite itself and not propagated to the first port 31 due to the short-circuiting conductive sleeve 36.

When the ferrite transmission device shown in FIG. 11 is used as digital phase modulator, a diode and a short-circuiting conductor are connected in parallel to the second port 32 and a load is connected to the third port 33, whereby due to the conductance and non-conductance of the diode, the phase of the input signal from the first port 31 is modulated and the signal is taken out through the load.

This ferrite transmission device also may be used as a switching element. In this case, a load is connected to each of the first and third ports 31 and 33, whereby a signal inserted from the third ports is taken out from the first or second port by reversing the DC magnetic field.

Figure 12:
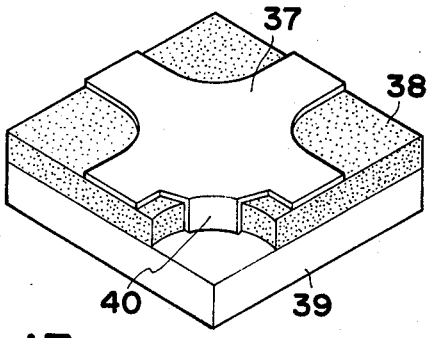

Shown in FIG. 12 is a modification of the ferrite transmission device of FIG. 11. In the modified device, a star-shaped conductor plate 37 having four ports is provided on a ferrite slab 38 in place of the T-shaped conductor plate 30 in FIG. 11. The conductor plate 37 is connected at an intermediate edge portion thereof to a ground plane 39 between two adjacent ports by a short-circuiting conductive sleeve or projection 40. This modified device may also be used as a reflection-type amplifier, wherein each of the second and third ports is provided with a negative resistance element for amplifying the inserted wave twice.

Figure 13:
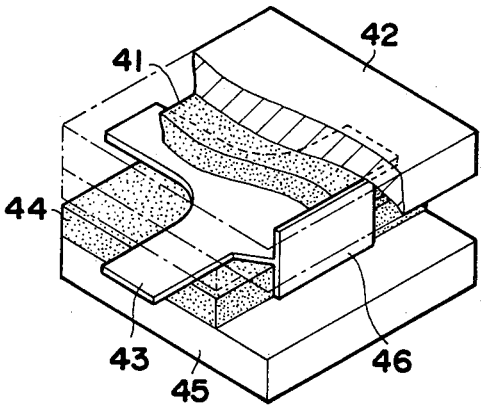

Although the present invention has been described with reference to preferred embodiments thereof, other modifications and alterations may be made. For example, apart from the microstripline transmission devices disclosed above, a stripline transmission device such as shown in FIG. 13 may be provided, in which a ferrite slab 41 and a ground plane 42 are additionally placed in turn on a conductor plate 43 which is mounted on a lower ferrite slab 44 placed on another ground plane 45, and the conductor plate 43 is connected or short-circuited to both of the ground planes 42 and 45 by a conductive member 46.

What is claimed is:

1. A magnetic transmission device for use in the edge-guided mode of propagation, said device comprising:

a ground plane, a magnetic field being formed perpendicular to said ground plane;

a ferrite slab positioned on said ground plane; and a conductor plate member positioned on said ferrite slab, said conductor plate member having:

first and second ports;

a first edge, extending from said first port to said second port forming means for concentrating microwaves inserted from said first port and propagating to said second port;

a second edge, extending from said second port to said first port, forming means for concentrating microwaves inserted from said second port and propagating in a direction toward said first port; and means, positioned at an intermediate portion of said second edge, for short-circuiting said conductor plate member to said ground plane such that microwaves inserted from said second port are absorbed within said ferrite slab and are not propagated to said first port.

2. A device as claimed in claim 1, wherein said magnetic transmission device comprises an isolator, and further comprising means for forming said magnetic field perpendicular to said ground plane.

3. A device as claimed in claim 1, wherein said short-circuiting means extends along said second edge in the direction of propagation.

4. A device as claimed in claim 1, wherein said short-circuiting means extends from said second edge transverse to the direction of propagation.

5. A device as claimed in claim 1, wherein said conductor plate member tapers outwardly from both of said first and second ports.

6. A magnetic transmission device for use in the edge-guided mode of propagation, said device comprising:

a ground plane, a magnetic field being formed perpendicular to said ground plane;

a ferrite slab positioned on said ground plane;

a conductor plate member positioned on said ferrite slab, said conductor plate member having:

at least three ports;

at least three edges, one each extending between adjacent two of said ports, forming means for concentrating microwaves propagating between the respective adjacent ports; and means, positioned at an intermediate portion of one of said edges, for short-circuiting said conductor plate member to said ground plane such that microwaves are not propagated between the respective ports of said one edge and are absorbed within said ferrite slab.

7. A device as claimed in claim 6, wherein said edges, other than said one edge, are smooth.

8. A circulator magnetic transmission device for use in the edge-guided mode of propagation, said device comprising:

a ground plane, a magnetic field being formed perpendicular to said ground plane;

a ferrite slab positioned on said ground plane; and a conductor plate member positioned on said ferrite slab, said conductor plate member having:

at least three ports;

at least three edges, one each extending between adjacent two of said ports, forming means for concentrating microwaves propagating between the respective adjacent ports;

a substantially central internal portion along which microwaves decay; and means, located at said central internal portion, for short-circuiting said conductor plate member to said ground plane.

9. A device as claimed in claim 8, wherein said edges are smooth.

10. A device as claimed in claim 8, wherein said short-circuiting means comprises a conductive member having a plurality of sides equal in number to the number of said edges, one each of said sides being directed toward and facing a respective one of said edges.

* * * * *